United States Patent [19]

Tanaka et al.

[11] 4,315,729

[45] Feb. 16, 1982

[54] GAS BURNER

[75] Inventors: Eiichi Tanaka, Yamatokoriyama; Noboru Ishibashi, Nabari, both of Japan

[73] Assignee: Matsushita Electric Industrial Co., Ltd., Osaka, Japan

[21] Appl. No.: 15,150

[22] Filed: Feb. 26, 1979

[30] Foreign Application Priority Data

| | | | |
|---|---|---|---|
| Mar. 2, 1978 | [JP] | Japan | 53-24287 |
| Mar. 2, 1978 | [JP] | Japan | 53-24288 |
| Mar. 2, 1978 | [JP] | Japan | 53-24289 |
| Mar. 2, 1978 | [JP] | Japan | 53-24291 |
| Aug. 24, 1978 | [JP] | Japan | 53-103716 |

[51] Int. Cl.[3] ..... F23N 5/00

[52] U.S. Cl. ..... 431/75; 431/10; 431/284

[58] Field of Search ..... 431/10, 75, 284, 354

[56] References Cited

U.S. PATENT DOCUMENTS

| | | | |
|---|---|---|---|
| 768,753 | 8/1904 | Kaufman | 431/284 |
| 3,656,878 | 4/1972 | Wright | 431/10 |
| 4,161,387 | 7/1979 | de Mere | 431/75 |

*Primary Examiner*—George E. Lowrance

*Attorney, Agent, or Firm*—Burgess, Ryan & Wayne

[57] ABSTRACT

A gas burner capable of automatically shutting off the supply of a gas fuel when the content of the oxygen in the air supplied to the gas burner drops to a predetermined level. It incorporates a Smithell's gas burner as a pilot burner which consists of an inner tube and an outer tube formed with an auxiliary air port. The sizes of these inner and outer tubes as well as the diameter and position of the auxiliary air port are so selected that when the contents of the oxygen in the air supplied to the gas burner drops to a predetermined level, the inner flame cone at the mouth of the inner tube is blown off. A sensor is provided which detects the blown off and generates the output signal in response to which a control means such as a solenoid-operated control valve may close the gas supply pipe. The pilot burner is of the general type in that it can burn gas fuels having different heating values.

10 Claims, 23 Drawing Figures

VOLUME OF THE GAS WHEN THE BURNING VELOCITY IS FASTEST

IN CASE OF THE GAS WHOSE BURNING VELOCITY IS SLOWEST

IN CASE OF THE GAS WHOSE BURNING VELOCITY IS FASTEST

OXYGEN DEFICIENCE CHARACTERISTICS WHEN THE DIAMETER OF THE OUTER TUBE IS VARIED (ELECTROMOTIVE FORCE CHARACTERISTICS OF THE THERMOCOUPLE WHEN THE OXYGEN CONCENTRATION IS 18%)

IN CASE OF THE GAS WHOSE BURNING VELOCITY IS SLOWEST (WHEN THE FLAME LENGTH IS LONG)

ELECTROMOTIVE FORCE CHARACTERISTICS WHEN THE DIAMETER OF THE AUXILIARY AIR PORT IS VARIED (IN CASE OF THE GAS WHOSE BURNING VELOCITY IS FASTEST)

ELECTROMOTIVE FORCE CHARACTERISTICS WHEN THE DIAMETER OF THE AUXILIARY AIR PORT IS VARIED (OXYGEN DEFICIENCY CHARACTERISTICS WHEN THE POSITION OF THE AUXILIARY AIR PORT IS VARIED)

GAS BURNER

BACKGROUND OF THE INVENTION

The present invention relates to an improvement of a gas burner.

In general the conventional gas burners such as gas-fired water heaters are provided with pilot burner-safety means which can automatically shut off the supply of a gas fuel to the gas burner when the pilot flame cone is blown off for any reason. However, this safety device cannot respond to reduction of the oxygen content in the air, below a normal level, so that incomplete combustion results, generating a large amount of carbon monoxide (CO) which represents a very serious hazard to the lives and health of people who is not aware of the incomplete combustion.

In order to overcome the above problem, there has been proposed and demonstrated a pilot burner which is so designed and constructed that when the content of the oxygen in the air supplied to the gas burner drops below a normal level, the flame cone may lift off the mouth of the pilot burner. The lift-off of the pilot flame cone in turn is detected by a suitable sensor so that the deficiency of the oxygen content in the air supplied to the gas burner may be detected and in response to the output signal a suitable safety means such as a control valve is closed so as to interrupt the supply of gas fuel. The pilot burner of the type described is effective when LNG or LPG is burned because of its slow burning velocity, but is ineffective when a town or city gas is burned because it has a high burning velocity. That is, as will as described in detail below with reference to FIGS. 1-5, the response is so slow that before the change in height of the pilot flame cone is detected, the main burner has generated a large amount of CO. When a city or town gas is burned, the height of the pilot flame cone is relatively high under normal conditions; that is, when sufficient oxygen is supplied, but when the content of oxygen in the air drops below a normal level, the height of the pilot flame cone is reduced so slowly that the difference between the normal and abnormal heights of the pilot flame cone cannot be detected immediately.

SUMMARY OF THE INVENTION

Accordingly, one of the objects of the present invention is to provide an improved Smithell type pilot burner which consists of an inner tube and an outer tube formed with an auxiliary air intake ports in accordance with the present invention so that when the contents of the oxygen in the air drops below a normal level, the states of the inner and outer flame cones can be very clearly distinguished from those under normal conditions.

Another object of the present invention is to provide an improved Smithell type pilot burner of the type described which may be used with differnt gas fuels without modification.

A further object of the present invention is to provide a gas burner which incorporates the pilot burner of the type described so that when the contents of the oxygen in the air supplied to the gas burner drops below a normal level, the supply of gas fuel may be automatically and immediately shut off, whereby poisoning by carbon monoxide may be prevented.

Briefly stated, to the above and other ends, the present invention provides a gas burner comprising an inner tube and an outer tube disposed concentrically of the inner tube and spaced apart therefrom both diametrically and axially by suitable distance and formed with an auxiliary air inlet port, the sizes of the inner and outer tubes and their relative position as well as the size and position of the auxiliary air inlet port being so determined that under the conditions that the boundary velocity gradient is between $7\times10^2$ and $4\times10^3$ $sec^{-1}$ and the equivalent ratio is between 1.1 and 2.0, the mixture of the primary air and a gas fuel admitted into the inner tube from the lower end thereof may be burned at its mouth, producing the inner or primary flame cone while the unburned mixture emerging from the inner or primary flame cone is mixed with the auxiliary air admitted through the auxiliary air inlet port and burned at the mouth of the outer tube, producing the outer or secondary flame cone.

In this specification, the term "boundary velocity gradient" is defined as the gradient of the tangent line of the flame while the term "the equivalent ratio", is (the volume of gas/the volume of air)/(the volume of gas)/(-the theoretical volume of air).

DESCRIPTION OF THE PREFERRED EMBODIMENTS

Prior Art, FIGS. 1-5

Figure 1:
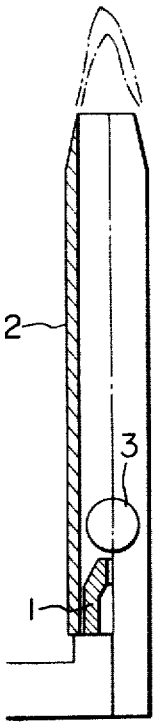
FIG. 1 PRIOR ART
FIG. 1 is a front view, partly in section, of a prior art pilot burner.
Figure 2:
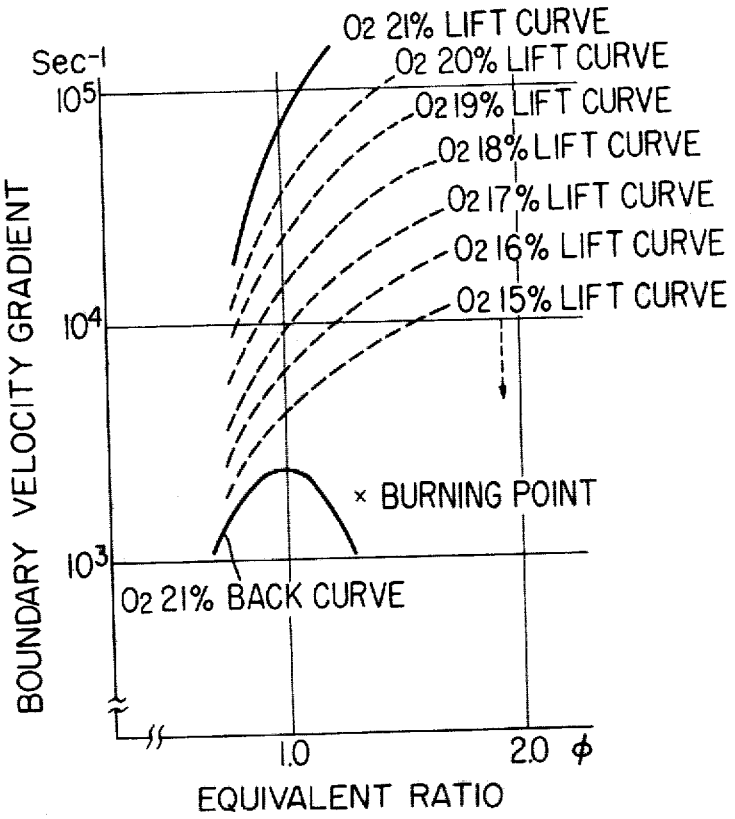
FIG. 2 PRIOR ART
FIG. 2 shows the combustion characteristic curves thereof.

Prior to the description of the preferred embodiments of the present invention, the prior art gas burner will be described briefly in order to more definitely and specifically point out the problems thereof. In FIG. 1 is shown a pilot burner comprising a nozzle 1 and a combustion tube 2 which is fitted over the nozzle 1 and extended upwardly and is formed with an air hole 3. The air admitted through this air hole 3 serves to lift the flame through the combustion tube 2. When the supply of the oxygen is not sufficient, the flame rises above a predetermined height, whereby the oxygen deficiency may be detected. This scheme or arrangement is satisfactory in the case of LNG and LPG which has a low combustion speed, but is unsatisfactory or unreliable in the case of the town or city gas which has a high combustion speed. More particularly before the flame of the pilot burner lifts so as to indicate the insufficient supply of the oxygen, the main burner produces a large quantity of CO. As shown in FIG. 2, the town or city gases have a high combustion speed and a high flame lift which is very slow to vary in response to the amount of the oxygen supplied. As a result, even in the case of the deficiency of the oxygen, the flame lift does not fall quickly so that it becomes very ambiguous to detect whether a sufficient amount of the oxygen is supplied only in terms of the flame lift.

Figure 3:
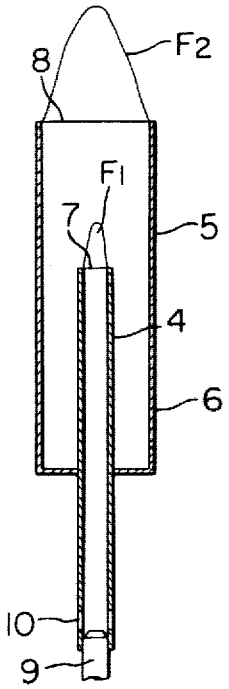
FIG. 3 PRIOR ART
FIG. 3 is a front view, in section, of another prior art pilot gas burner.

As shown in FIG. 3, there has been devised and demonstrated a gas burner of the type wherein the primary flame and the secondary flame may be separated from each other so that the states of the flames may be varied over a wide range depending upon the supply of oxygen even when town or city gas having a high combustion speed is used. This gas burner comprises a main body 6 consisting of an inner tube 4 and an outer tube 5. The mouth or the flameholder 8 of the outer tube 5 is vertically upwardly spaced apart from the mouth or the flameholder 7 of the inner tube 4 by a suitable distance. The inner tube 4 has a nozzle 9 fitted at the lower end thereof and is formed with air ports 10. The gas supplied through the nozzle 9 and the primary air admitted through the air ports 10 are mixed and burned to form the inner or primary cone of flame $F_1$ while the unburned gas burns at the mouth 8 of the outer tube to form the outer or secondary cone of flame $F_2$. It is well known in the art that in a Smithell's burner, wherein the inner and outer flame cones $F_1$ and $F_2$ are separated from each other as described above, the state of the inner or primary flame cone $F_1$ is very sensitive to the concentration of the oxygen in the primary air. That is, when the contents of the oxygen is less than a predetermined level, the inner or primary flame cone $F_1$ lifts off the mouth 7 of the inner tube 4 and blows out. Therefore the Smithell's burner may be combined with suitable means capable of detecting whether the inner or primary flame cone $F_1$ exists or blown off so as to provide a device for detecting an insufficient supply of oxygen. Thus accidents due to carbon monoxide may be prevented.

However, the Smithell's burner has an inherent defect that the combustion range in which both the primary and secondary flame cones $F_1$ and $F_2$ may be securely established is very limited. As a result, a wide variety of nozzles must be provided for various types of gases, raising an economic problem.

Figure 4:
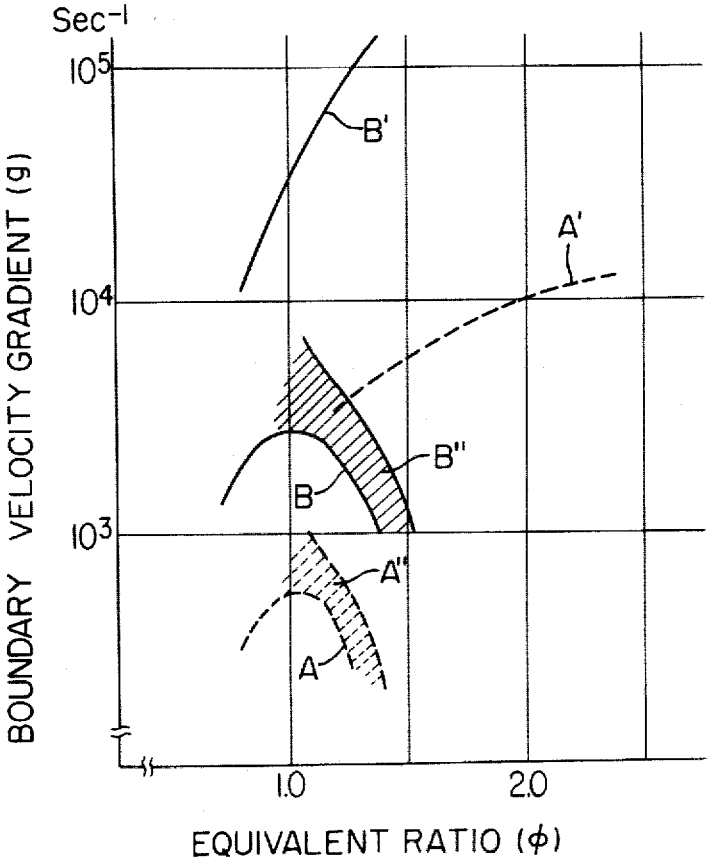
FIG. 4 PRIOR ART
FIG. 4 shows the combustion characteristic curves thereof.

This defect will be described in some detail with reference to FIG. 4 showing the combustion or burning characteristic curves. Burning velocity is plotted along the ordinate while the equivalent ratio, along the abscissa. The equivalent ratio $\phi$ is defined as [(the volume of gas)/(the volume of air)/(the volume of gas)/(the theoretical volume of air)]. The "back curve" and the "lift curve" of the gas with a slowest burning velocity are indicated by A and A', respectively. Those of the gas with a highest burning velocity, by B and B', respectively. With the burner of the type shown in FIG. 3, the inner and outer flame cones $F_1$ and $F_2$ may be established separately from each other in the region A'' in the case of the gas with a slowest burning velocity, while in the case of the gas with a highest burning velocity, they may be established in the region B''. That is, depending upon the gas to be used, the region in which both the inner and outer flame cones $F_1$ and $F_2$ may be established securely and separately from each other varies.

Figure 5:
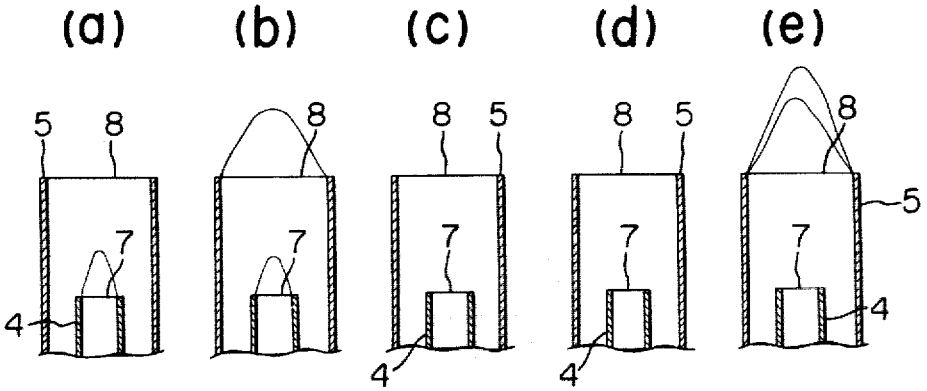
FIG. 5 PRIOR ART
FIG. 5 shows the states of the inner and outer flame cones thereof depending upon the amount of the primary air supplied.

FIG. 5 shows the flame cones depending upon the equivalent ratio $\phi$ defined above. The equivalent ratio $\phi$ or the amount of primary air is progressively increased or decreased from FIG. 5(*a*) to FIG. 5(*d*). At $\phi=1$, all the gas burns at the mouth 7 of the inner tube 4 as shown in FIG. 5(*a*) so that no outer or secondary flame cone $F_2$ is formed. When the ratio $\phi$ increases or when the amount of primary air decreases, the unburned gas emerges from the inner cone at the mouth 7 of the inner tube 4 is supplied with the secondary air from the surrounding atmosphere at the mouth 8 of the outer tube 5 so that the outer or secondary flame cone $F_2$ is formed as shown at (b) in FIG. 5. When the ratio $\phi$ increases further, the amount of the primary air decreases so that no inner or primary flame cone $F_1$ is formed at the mouth 7 of the inner tube 4 as shown at (c) in FIG. 5. Since the flow of the gas-air mixture is reduced at the mouth 8 of the outer tube 5, the flame cone $F_2$strikes back into the outer tube 5, but there is not a sufficient supply of the oxygen in the outer tube 2 so that no flame cone is produced therein. As a result, neither the inner or the outer flame cone is produced as shown at (c) or (d) in FIG. 5.

When the ratio $\phi$ is further increased, no flashback occurs so that only the outer or secondary flame cone $F_2$ is produced as shown at (e) in FIG. 5.

As described above, in the case of the conventional Smithell's burner the combustion region in which both the inner and outer flame cones $F_1$ and $F_2$ may be produced in a stabilized manner is very limited so that it cannot be used with various types of gases.

THE INVENTION

First Embodiment, FIGS. 6–21

Prior to the detailed description of the first embodiment with reference to FIGS. 6–21, its features will be briefly described. It has a main body consisting of an inner tube and an outer tube. The mouth at which is produced the outer or secondary flame cone is vertically upwardly spaced apart by a suitable distance from the mouth of the inner tube at which is produced the inner or primary flame cone. In addition to the fuel gas and the primary air, auxiliary air is admitted into the inner tube. The flow rate of the auxiliary air is so selected that the inner or primary flame cone $F_1$ may be produced in a stabilized manner within the range of the gradient of the boundary velocity from $7\times10^2$–$4\times10^3$ $sec^{-1}$ and within the range of the equivalent ratio $\phi$ between 1.1 and 2.0. Of course the flow rate of the primary air fed into the inner tube is so controlled as to maintain the above two conditions. Therefore with a single burner various types of gas fuels may be equally burned in such a way that the inner and outer flame cones may be produced under the above conditions. The burner of the present invention is therefore satisfactorily used as a means for detecting the insufficient supply of the oxygen or air to the gas burner as will be described in detail hereinafter.

The dimensional data of the first embodiment of the gas burner in accordance with the present invention are as follows:

| | |
|---|---|
| The inner diameter of the mouth of the inner tube: | 4 to 5.5 mm |
| The length of the inner tube: | 55 to 80 mm |
| The inner diameter of the mouth of the outer tube: | 8 to 20 mm |
| The difference in height between the mouth of the outer tube and the mouth of the inner tube: | 20 to 40 mm |
| The diameter of the secondary air ports: | 3 to 4 mm |
| The distance between the mouth of the inner tube and the center of the auxiliary air port: | 5 to 30 mm |
| The distance between a thermocouple and the inner or primary flame cone: | 12 to 35 mm. |

The gas burner with the above dimensions may be incorporated in the gas-fired water heater or the like and may burn any type of gas fuel. As a result, it may be used as a general type detector capable of detecting an insufficient supply of the oxygen and hence the air, whereby the accidents due to the decrease in the contents of the air in rooms may be completely eliminated.

It is to be understood that instead of the thermocouple T described above, any suitable oxygen sensor means may be used. There are for instance an oxygen concentration cell which utilizes a high temperature solid electrolyte which conducts oxygen ions, an oxygen partial pressure sensor such as titanium oxide, an ionic current detector and so on.

Figure 6:
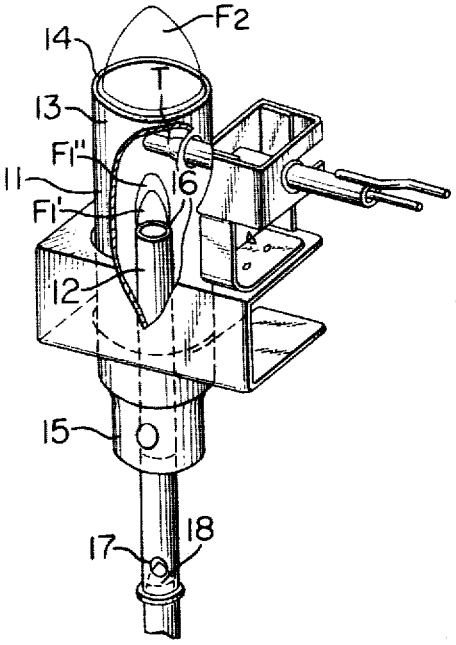
FIG. 6 is a perspective view of a first embodiment of a gas burner in accordance with the present invention.
Figure 9:
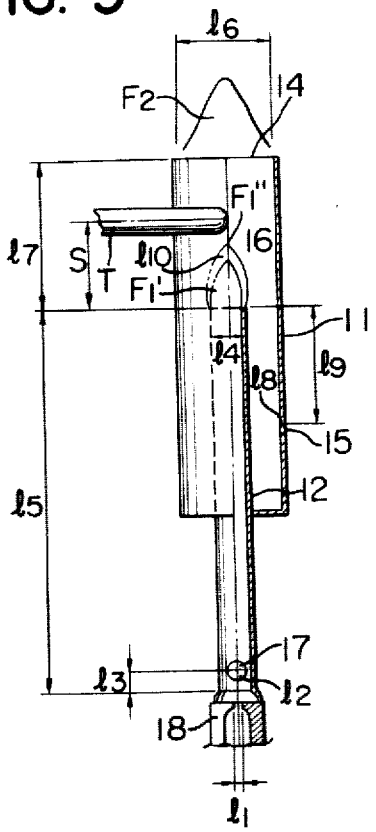
FIG. 9 is a longitudinal sectional view thereof.

Now referring to FIG. 6, 11 is a burner main body consisting of the inner tube 12 and the outer tube 13. The outer tube 13 has the secondary or outer flame cone mouth 14 at the upper end thereof, and the lower peripheral wall thereof is formed with the auxiliary air port 15 through which a small amount of air passes. Meanwhile the inner tube 12 is disposed within the outer tube 13 and has the primary or inner flame cone mouth 16 at the upper end thereof which is located downwardly of the secondary or outer flame cone mouth and upwardly of the auxiliary air port 15. The lower wall is formed with a primary air port 17. 18 shows a gas nozzle attached to the lower opening of the inner tube 2.

Next the combustion operation of the above burner will be described. The gas injected through the gas nozzle 18 and the primary air induced through the primary air port 17 are sufficiently mixed within the inner tube 12 and obtain a small amount of air flowing through the auxiliary air port 15 and burn at its primary or inner flame cone mouth 16, thereby producing the primary or inner flame cone $F_1$ consisting of an-inner flame cone $F_1'$ and a outer flame cone $F_1''$. The gas which has not burned here emerges out of the secondary or inner flame cone mouth 14 at the leading end of the outer tube and obtains the air from the surrounding atmosphere, or the secondary air, to burn, thereby producing the secondary or outer flame $F_2$.

In the case of the separate flame combustion of the type described above, the primary flame cone $F_1$ which is dependent, is in the process of the instable combustion and is very sensitive to the contents of the oxygen because the supply of the air through the auxiliary air ports 15 is controlled. And when the contents of the oxygen in the air drops below a predetermined level, the primary flame cone $F_1$ blows off so that only the second flame cone $F_2$ remains.

Next the effects on the combustion of the auxiliary air will be described with reference to FIG. 7.

That is, FIG. *7a* shows that the equivalent ratio $\phi$=[(the volume of gas)/(the amount of air)/(the amount of gas)/(theoretical amount of air)] is about 1. In this case, of course the primary or inner flame cone $F_1$ is produced only at the primary or inner flame cone mouth 16.

When the amount of air is decreased further so as to increase the ratio $\phi$, the secondary or outer flame cone $F_2$ is produced at the secondary or outer flame cone mouth 14 as shown at b. Even when the ratio $\phi$ is increased, the separated flames remain as shown at c and d. It is FIGS. *7c* and *7d* that are different from FIGS. *5c* and *5d* which show the prior art examples. The difference resides in the formation of the outer flame cone $F_1''$ due to the supply of the auxiliary air.

That is, because of the existence of the outer flame cone $F_1''$, the blow off of the primary flame cone $F_1$ becomes difficult. Even when the equivalent ratio $\phi$ increases considerably, the primary flame cone $F_1$ remains.

Figure 7:
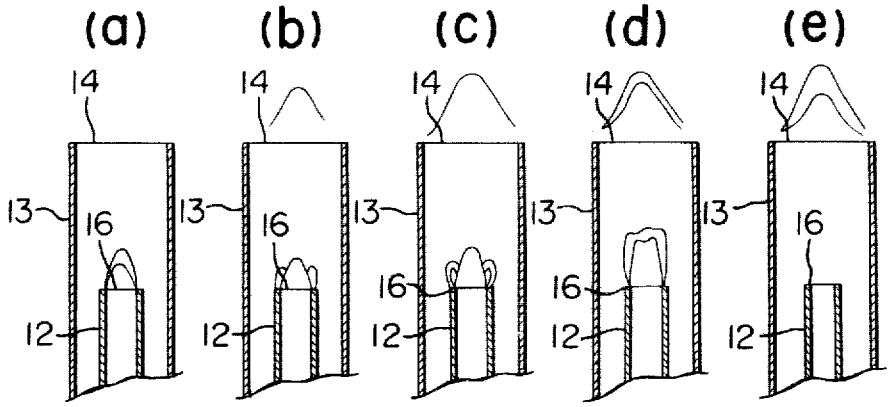
FIG. 7 shows the states of the inner and outer flame cones thereof dependent upon the amount of the primary air supplied.

When the increase of the equivalent ratio $\phi$ continues, as shown at d in FIG. 7, the tip of the primary flame cone $F_1$ is torn off, and finally as shown at e the primary or inner flame cone $F_1$ blows off while only the secondary flame cone $F_2$ remains.

Figure 8:
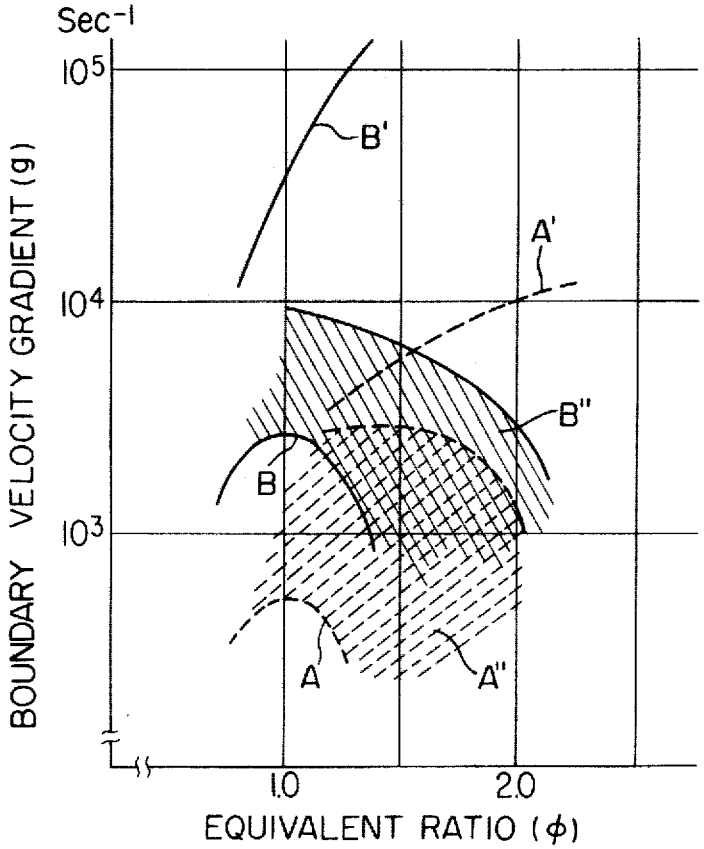
FIG. 8 is a graph used for the explanation thereof.

These combustion or burning conditions may be expressed in terms of the burning characteristics as shown in FIG. 8. The separate flame combustion regions A'' and B'' are enlarged. And when the equivalent ratio $\phi$=1.1 to 2.0 and the boundary velocity gradient $g=7\times10^2-4\times10^3$, the separate flame combustion or burning regions are overlapped so that when the equivalent ratio $\phi$ and the velocity gradient g are set within the above ranges, the single burner can accomplish the separate flame combustion of various types of gas fuels. In other words, the primary flame cone $F_1$ may be blown off at a predetermined equivalent ratio $\phi$ or at a predetermined level of the oxygen contents.

In the burner wherein the primary and secondary flame cones are separated, the oxygen deficiency sensor which is the thermocouple T in this embodiment is disposed so that the electromotive force may be generated by the temperature received from the primary or inner flame cone and in the case of the normal combustion an electromagnet valve is held open. However, when the content of oxygen drops for any reason, the primary flame cone 9 lifts and the thermocouple electromotive force drops so that the electromagnet valve is released.

The burner which operates in the manner described above responds immediately to variations in the content of the oxygen in the air even though the variation is very small and it burns in a stable manner in the case of normal combustion. Furthermore, in order to utilize a wide variety of gas fuels without modification of the construction of the burner, some of the important dimensions must be determined. They are the nozzle diameter $l_1$ which determines the combustion setting position; the diameter $l_2$ of the primary air port; the position $l_3$ of the primary air port; the diameter $l_4$ of the primary flame cone mouth; the length $l_5$ of the inner tube; the outer tube diameter $l_6$ which stabilizes the primary flame cone and cuts off part of the outer flame, thereby causing the quick change in the case of the oxygen deficiency; the difference in length between the inner and outer tubes $l_7$; the diameter of the auxiliary air port $l_8$; the position of the auxiliary air port $l_9$ and the distance $l_{10}$ from the thermocouple T to the primary flame cone. These will be described in more detail below (See FIG. 9).

Figure 10:
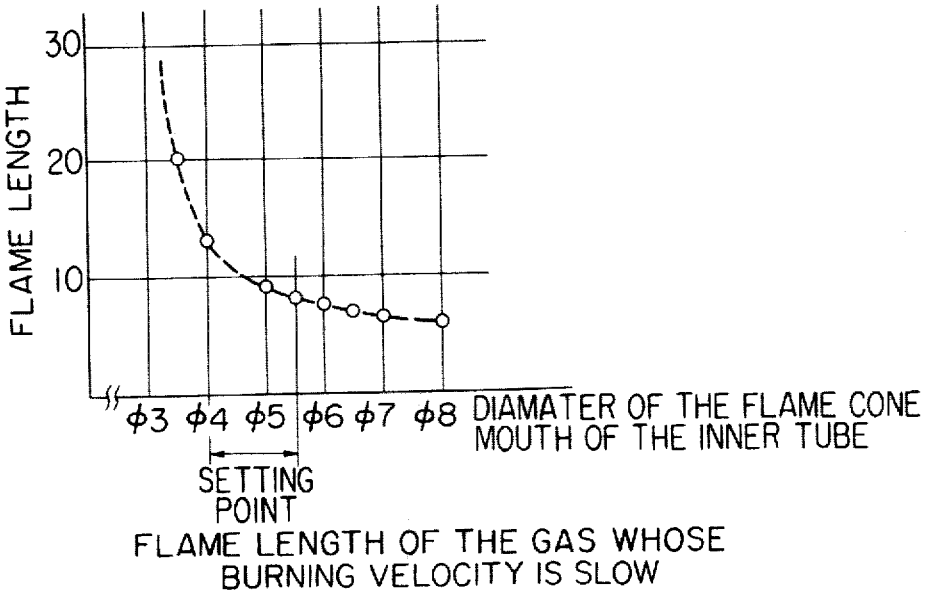
FIG. 10 is a graph used for the explanation of the relationship between the inner diameter of the inner tube and the length or height of the flame cone produced at the mouth thereof.

When the dimensions for practical mounting on equipment are considered, there exists a suitable burner size or capacity as an oxygen deficient sensing pilot burner for a hot water heater, a stove or the like and there exist dimensions corresponding to the suitable burner size. In order that it may be possible to ignite the main burner as a pilot burner which is normally used and from the view point of the pilot heating and other performances, it has been preferable to select 50 to 200 KCal/h as a combustion quantity. Typical dimensions at which the flame may burn at the primary flame cone mouth at this combustion quantity are the diameter $l_4$ of the primary flame cone between 4 to 5.5 mm (the opening area being 12.56 to 23.75 $mm^2$) which are used as references. That is, when $\phi$ is less than 4 mm, I the nozzle diameter must be extremely reduced in the case of LPG having a high heating value and II as shown in FIG. 10 in the case of a gas fuel with a low burning velocity, the flame length suddenly increases less than 4 mm in diameter and the control of this flame length is difficult because of the tolerances and so on of the primary flame cone mouth diameter. On the other hand, when $\phi$ is in excess of 5.5 mm, the burning velocity is fast so that flash back occurs.

Figure 11:
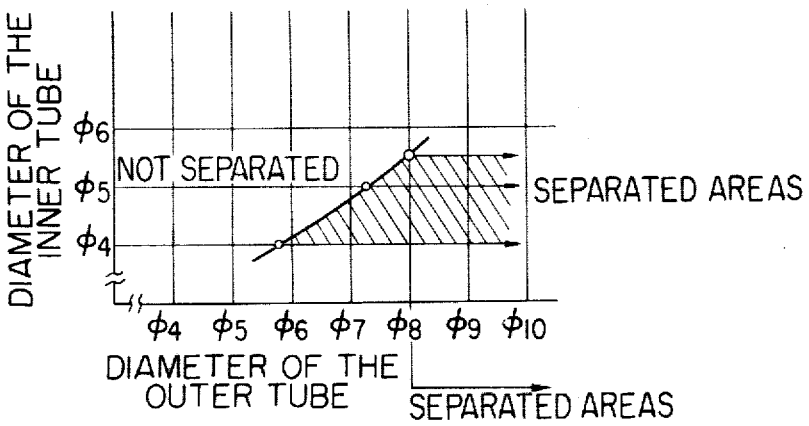
FIG. 11 is a graph used for the explanation of the relationship between the inner diameters of the inner and outer tubes.
Figure 12:
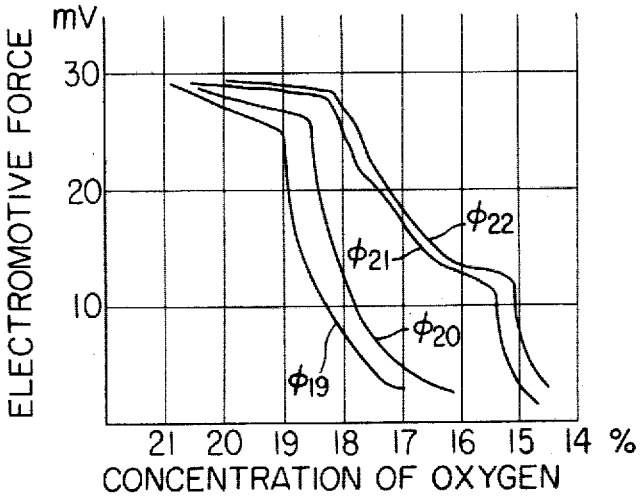
FIG. 12 is a graph illustrating the relationship between the oxygen and the electromotive force generated by a thermocouple which is used as an oxygen content sensor.

With the primary flame mouth thus determined, the flow rate of the mixed gases is determined for a specific type of gas fuel. When a suitable position of the combustion of the primary flame cone is determined so as to separate flames, there must be a difference between the diameters of the inner and outer tubes. As shown in FIG. 11, the diameter at which the combustion continues in such a way that the burning occurs at the secondary flame cone mouth while no lift occurs at the primary flame cone mouth is more than 8 mm in the case of the outer tube. In the case of flash insufficient supply of the oxygen, the boundary velocity gradient of the gas is reduced so that the lift occurs at the primary flame cone mouth. If this primary flame may be burned at the secondary flame cone mouth 14, the sensitivity as the first oxygen deficiency detection may be maintained because there exists no flame at the primary flame cone mouth. Therefore flash back from the secondary flame cone mouth 14 to the primary flame cone mouth 16 must be avoided. As a result, as shown in FIG. 12, the region is such that the outer tube diameter is less than 20 mm. When the secondary flame cone mouth diameter is in excess of 20 mm, even in the case of the oxygen deficiency, the flame goes up and down between the primary and secondary flame cone mouths 14 and 16 so that the drop in the electromotive force is delayed. As a result, the difference between the oxygen deficiency and the normal combustion becomes small and the sensitivity is degraded. [(the area of the outer tube)/(the area of the inner tube) $=(8/5.5)^2-(20/4)^2=2.12-25$ ].

Figure 13:
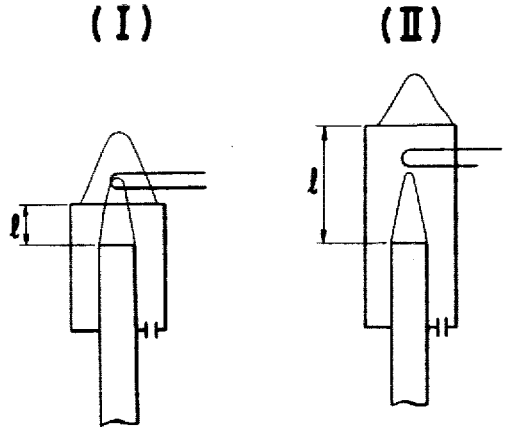
FIG. 13 shows the difference in shape between the outer and inner flame cones depending upon the distance between the mouths of the outer and inner tubes.
Figure 14:
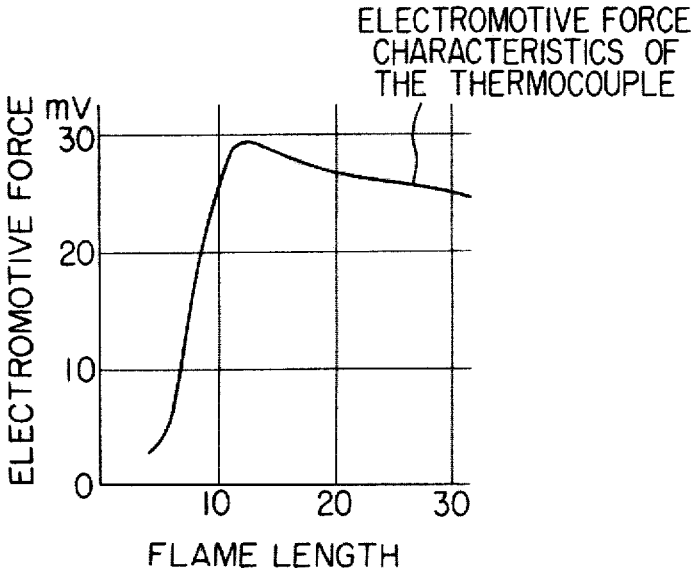
FIG. 14 shows the relationship between the height of the inner flame cone and the electromotive force generated by the thermocouple.
Figure 15:
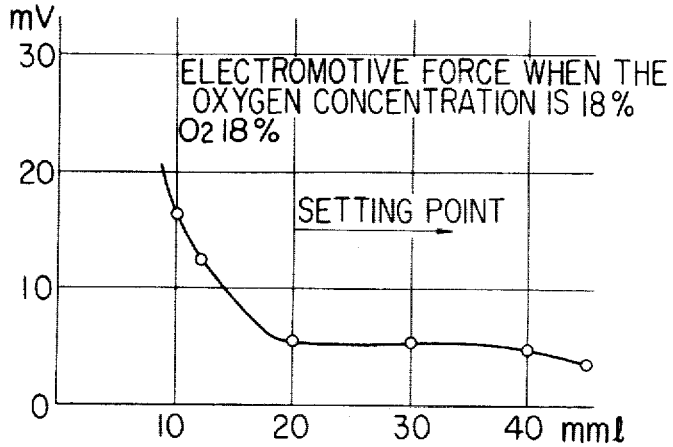
FIG. 15 shows the relationship between the distance between the mouths of the inner and outer tubes on the one hand and the electromotive force generated by the thermocouple when the oxygen contents is 18%.
Figure 16:
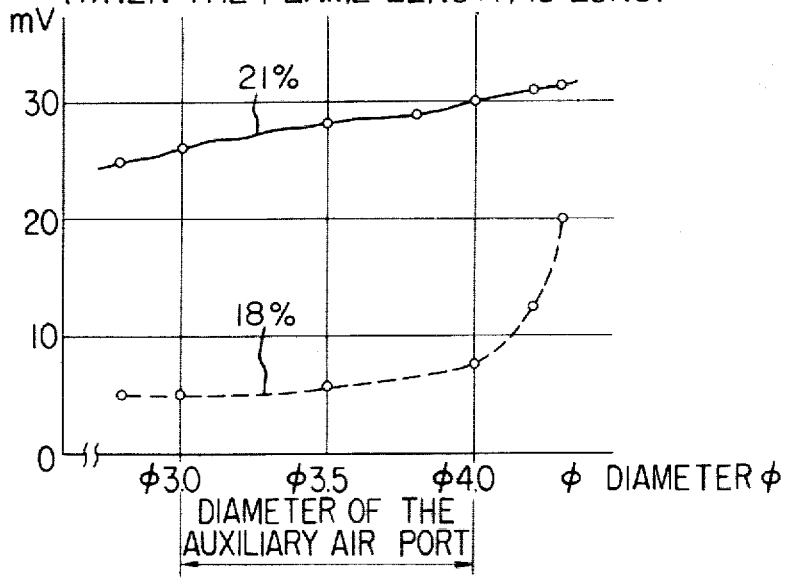
FIG. 16 shows the relationship between the diameter of the auxiliary air inlet port and the electromotive force generated by the thermocouple with the oxygen contents as a parameter when a gas fuel having a highest burning velocity is burned.

As shown in FIG. 13, the difference in height between the primary and secondary flame cone mouths 16 and 14 must be longer than any of the maximum flame length of the primary flame cone because the behavior of the primary flame cone $F_1$ may be detected only by clearly separating the primary and secondary flame cones $F_1$ and $F_2$, thereby detecting the oxygen deficiency (See FIG. 13 II). Furthermore, required is the length which is free from the temperature influence from the flame transferred to the secondary flame cone mouth 14 in the case of the oxygen deficiency to the thermocouple. That is, as shown in FIG. 14, the maximum length of the flame is of the order of 12 mm. When the length is increased, the temperature variations of the flame are small, but as seen from FIG. 15, the influence of the flame produced at the outer flame cone mouth in the case of the oxygen deficiency arises when the length is between 12 and 20 mm. As a result, the secondary flame cone mouth 14 must be spaced apart from the primary flame cone mouth 16 by more than 20 mm. However, when the secondary flame cone mouth 14 is spaced apart from the secondary flame cone mouth by too far a distance so that the increase in length of the outer tube results, the draft is increased so that the stability is degraged in the case of the normal combustion. Thus, in practice, the length is preferably less than 40 mm so that the gas burner may be incorporated in the equipment.

The auxiliary air is proposed as means for producing the primary flame cone of any types of gas fuels at the primary flame cone mouth and for enclosing the primary flame cone with a thin outer flame cone, thereby attaining stability. However, when the auxiliary air is increased in volume, as the variation in the electromotive force of the thermocouple in the case of the oxygen deficiency indicates, when the diameter of the auxiliary air port is increased beyond 4.0 mm, the electromotive force of the thermocouple will not drop even in the case of the oxygen deficiency. As a result, the diameter of the auxiliary air port must be made less than 4.0 mm so that the electromotive force of the thermocouple may be dropped prior to the generation of the CO from the main burner, thereby releasing the electromagnet valve so as to close a gas circuit.

Figure 17:
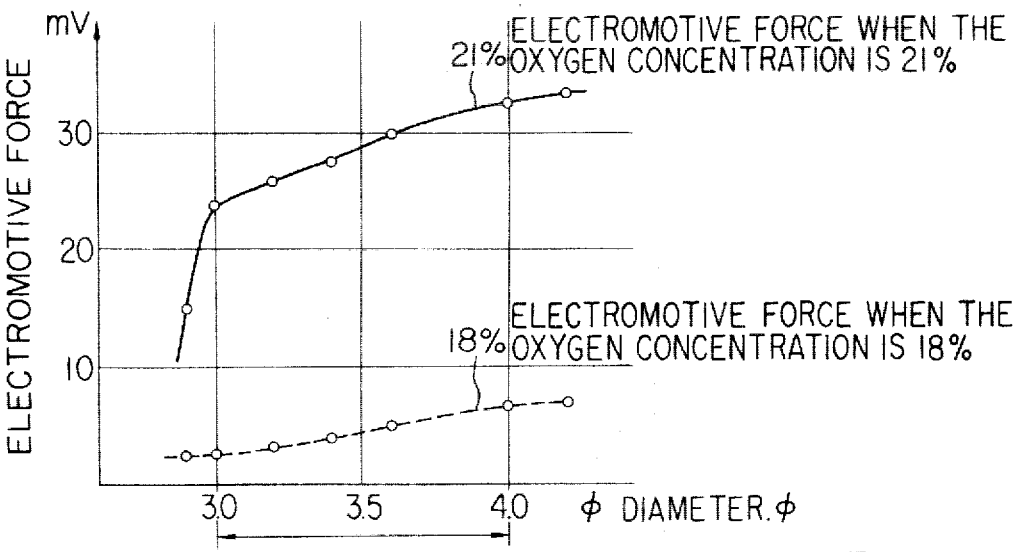
FIG. 17 is a graph similar to FIG. 16 but when a gas fuel with a slowest burning velocity is burned.

On the other hand, in order that the stability may be maintained in the case of the normal combustion, as shown in FIG. 17, there must be provided the electromotive force sufficient for not releasing the electromagnet valve in the gas circuit even when the gas fuel is used which tends to lift at a minimum burning velocity. According to the experiments, it was found out that the auxiliary air port with the diameter $l_7$ of greater than 3 mm must be opened so that the range in which the electromotive force will not drop must be used.

Figure 18:
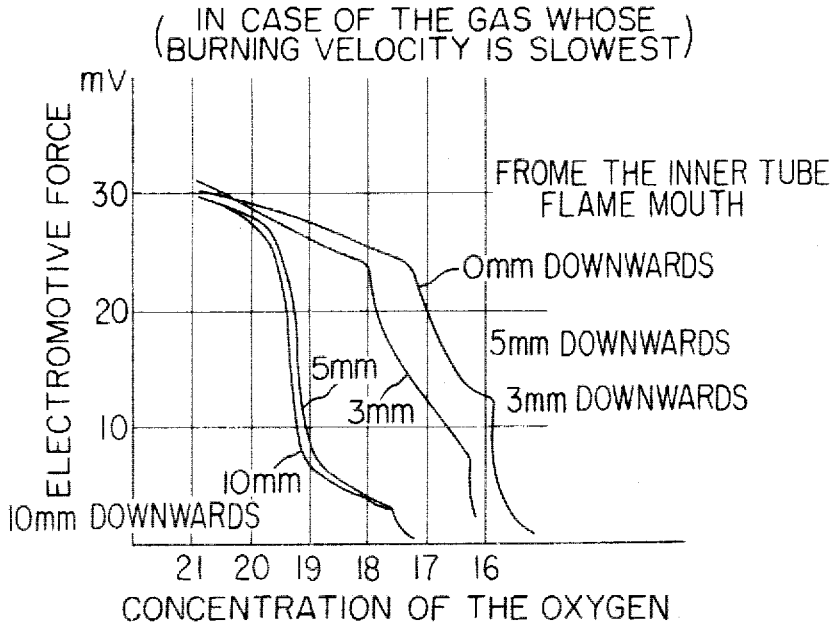
FIG. 18 shows the relationship between the oxygen contents in % and the electromotive force generated by the thermocouple with the position of the auxiliary air inlet port as a parameter.
Figure 19:
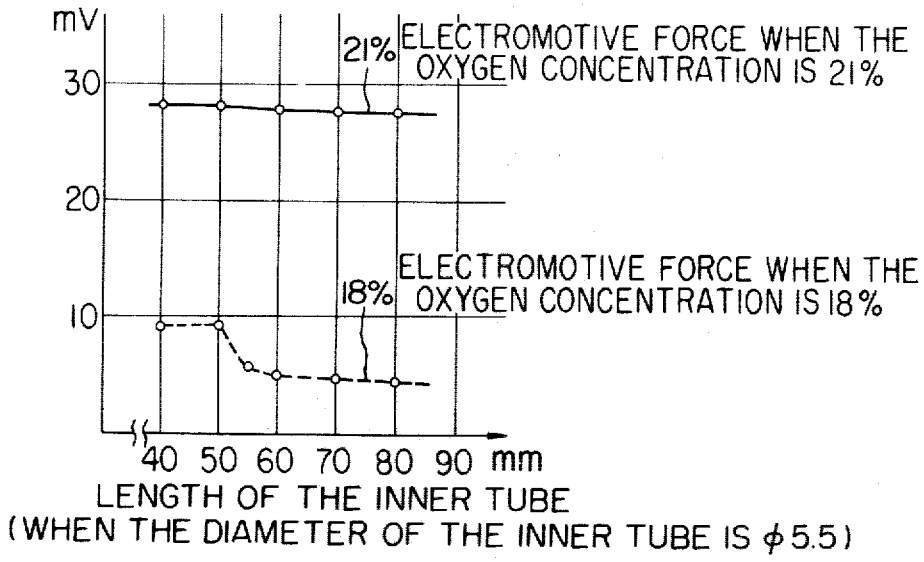
FIG. 19 shows the relationship between the length of the inner tube and the electromotive force generated by the thermocouple with the oxygen contents as a parameter.

Furthermore, this auxiliary air supply means is disposed below the primary flame cone mouth 16 so that the flow from the below may be provided and consequently the lift-off may be smoothly effected in the case of the oxygen deficiency. According to the experiments, as shown in FIG. 18, when the position 1-8 of the auxiliary air port is spaced apart from the inner tube flame mouth position by 0-5 mm downwards thereof, the contents of the oxygen which lifts in the case of the oxygen deficiency becomes low so that the sensitivity is low. However, if it is more than 5 mm, the lift may be smoothly effected. However, when the outer tube is extended too much below the primary flame cone mouth 16, the temperature rises because of the influence of the suction through the primary air port formed at the lower portion of the inner tube and due to the heating of the outer tube by the primary flame. When the outer tube is extended, the temperature of the gas mixture flowing through the inner tube rises so that in the case of the gas fuel with a highest burning velocity, there is a danger of resulting in the occurence of flash back. Therefore, in practice the position of the auxiliary air port which is formed through the outer tube must be less than 30 mm below the primary flame cone mouth. Furthermore, this dimension is limited by the length of the inner tube to be described below. The so-called mixing tube through which the mixture of gas fuel and air for producing the primary flame cone $F_1$ flows has been reported to preferably have a diameter 8 times the throat diameter. However, according to the experiments, when it is 8 times, excessive fluctuations of the primary flame cone result. As a result, the boundary velocity gradient increases so that the lift-off in the case of the oxygen deficiency is delayed. It must be more than 10 times as much as the diameter of the primary flame cone mouth and the inner tube must be greater than 55 mm in length so that the primary flame may form a beautiful laminar layer flame and may smoothly lift-off in the case of the oxygen deficiency. (In the case of the diameter of the inner tube being 5.5 and See FIG. 19). When the length of the inner tube is in excess of 55 mm, it may have any length from the theoretical standpoint when the drop in suction due to the passage resistance within the tube may be covered. However, when it is incorporated into an equipment or the like, the pilot burner is about 100 mm at the most in practice. Therefore it is preferable to use the inner tube less than 80 mm in length.

When the dimensions are determined in the manner described above, it may be used as an oxygen deficiency pilot burner capable of encountering any type of gas fuels. However, the city or town gas, LNG and LPG have different heating values so that when the heating value is to be changed, the nozzles are changed depending upon the heating value. And the suction of the primary air is different depending upon the diameters of the nozzles. As a result, the damper adjustment must be made at the primary air port depending upon the type of gas fuel used as before.

Figure 20:
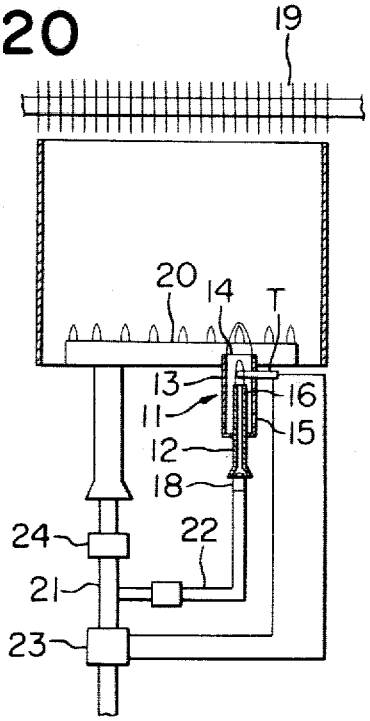
FIG. 20 shows a gas-fired water heater incorporating a pilot gas burner in accordance with the present invention.

FIG. 20 shows an illustrative example wherein the burner of the type described above is used as a hot water heater. That is, 19 is a heat exchanger and 20, a main burner. The burner main body 11 in accordance with the present invention is disposed in the proximity of the main burner. A branched gas line 22 branched from a gas line 21 to the main gas burner 20 is connected to the gas nozzle 18. 23 is an electromagnet safety valve inserted in the gas line at the upstream of the branched point of the branched gas line 22; and T, a thermocouple which is a power source for it, it being located above the primary flame cone mouth 16 of the burner main body 11. 24 is a governer for controlling the combustion by the main gas burner 20.

Normally, the burner main body 11 burns the gas fuel, forming the primary and secondary flame cones. The thermocouple T is heated by the said primary flame to generate the thermal electromotive force, thus maintaining the electromagnet safety valve 23 opened.

When the electromagnetic safety valve 23 is opened, the gas fuel is supplied to the main gas burner 20 and ignited by the secondary flame.

When the contents of the oxygen drops to a predetermined level due to the contamination of air, the primary flame blows off so that no thermo-electric motive force is obtained from the thermocouple T. As a result, the electromagnetic safety valve 23 is closed and consequently the supply of gas is interrupted.

With the above arrangement and operation, in order to encounter various types of gas fuels, the relationship in position between the thermocouple and the primary flame cone becomes important. In the case of the gas fuel with a faster burning velocity, the flame length is short, but in the case of the gas fuel with a slow burning velocity, the flame length is longer.

Figure 21:
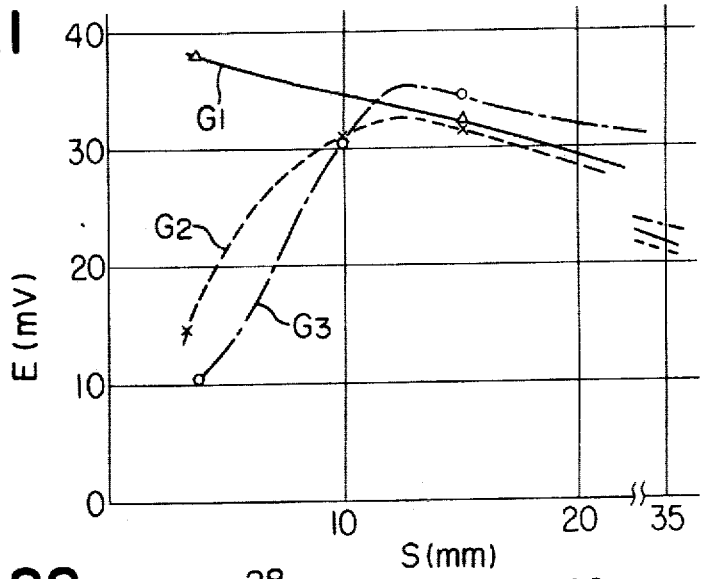
FIG. 21 shows the relationship between the distance between the primary flame cone and the thermocouple and the electromotive force generated by the latter.

FIG. 21 obtained from the experiments the relationship between the distance S between the primary flame cone mouth 16 in the burner 11 (See FIG. 9) and the thermocouple T and the electromotive force E of the thermocouple T. Used in the tests were the gas $G_1$ with the fastest burning velocity; the gas $G_3$ with the slowest burning velocity; and the gas $G_2$ with an intermediate burning velocity.

With the distance $S=5$ mm and with the gas $G_1$, the electromotive force E is high. With the gases $G_2$ and $G_3$, the electromotive force E is low. With the gas $G_1$, the flame length is short. This means that the thermocouple T is efficiently heated. However with the gases $G_2$ and $G_3$, the flame becomes longer in length and the thermocouple is positioned within the flame so that no efficient heating is made.

With the increase in the distance S, the difference in the electromotive force E between the gases $G_1$, $G_2$ and $G_3$ becomes less. With the distance of longer than 12 mm, the variations are almost negligible.

However, when the thermocouple T is spaced apart from the primary flame cone mouth 16 by a distance of longer than 12 mm, the electromotive force becomes constant regardless of the type of the gas fuel used so that the electromagnetic valves of the same specifications may be employed.

The upper limit of the distance S is determined depending upon the thermoelectromotive force and the shapes of the burners, but in practice it is preferably less than 35 mm.

Figure 22:
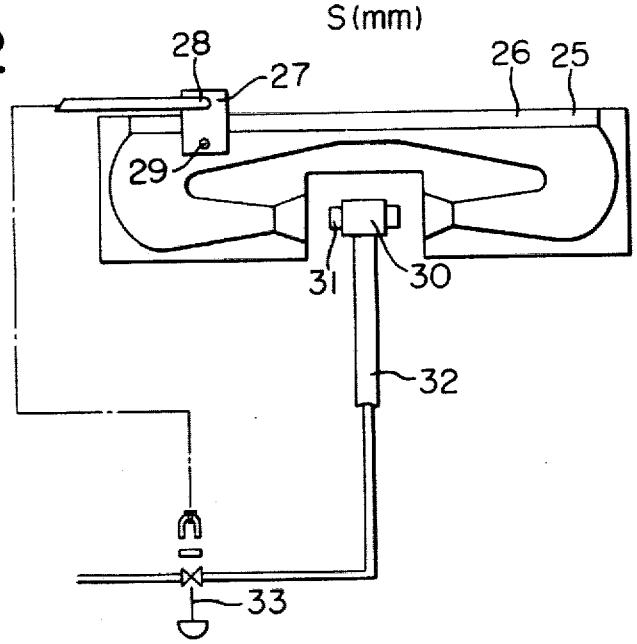
FIG. 22 is a schematic front view of a second embodiment of the present invention.
Figure 23:
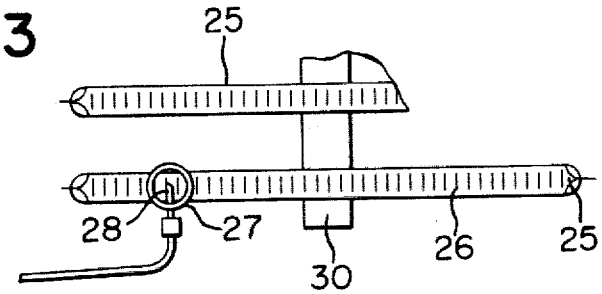
FIG. 23 is a top view thereof.

Another embodiment of the present invention is shown in FIGS. 22 and 23. An outer tube 27 is extended from a fuel or flame element 26 of a Bunsen type main burner 25. An oxygen deficiency sensor 28 such as a thermocouple may be extended through the outer tube 27. The outer tube 27 is formed with an auxiliary air intake port 29. 30 is a nozzle holder; 31, a nozzle; 32, a gas supply pipe. When the sensor 28 detects the abnormal combustion, a valve 33 is closed to interrupt the supply of gas so that an accident may be prevented. As described above, it is possible to use a part of the main burner as an inner tube.

What is claimed is:

1. An improved pilot gas burner of the Smithell type, comprising:

an inner tube having an inlet end for receiving a mixture of combustible gas and primary air, and an open end comprising a primary flame cone mouth having a predetermined cross-sectional area;

an outer tube surrounding and coaxial with said inner tube adjacent and extending beyond said primary flame cone mouth thereof, said outer tube having (i) an auxiliary air inlet port in the wall thereof at a position between said inlet end and primary flame cone mouth of said inner tube, and (ii) an open end adjacent said primary flame cone mouth comprising a secondary flame cone mouth having a given cross-sectional area;

the ratio between said given area of said secondary flame cone mouth and said predetermined area of said primary flame cone mouth being in the range of 2.12 to 25; and means for controlling the flow rates of said combustible gas, primary air and secondary air so that (i) primary and secondary flame cones may be sustained at said primary and secondary flame cone mouths respectively, (ii) the equivalent ratio respecting said combustible gas and primary air is in the range of 1.1 to 2.0, and (iii) the gradient of boundary velocity gradient of said combustible gas is in the range of 700 to 4,000 $sec.^{-1}$.

2. The gas burner according to claim 1 further comprising means for detecting the presence or absence of said primary flame cone.

3. A gas burner as defind in claim 1 wherein said auxiliary air port is formed through the wall of said outer tube at a position spaced apart by 5–30 mm from said primary flame cone mouth.

4. A gas burner as defined in claim 1, wherein a portion of said inner tube comprises a burner main body, and $l > 10d$, where l is the length of said burner main body and d is the inner diameter thereof.

5. A gas burner as defind in claim 1, wherein the inner diameter of said primary flame cone mouth of said inner tube is 4–5.5 mm; the length thereof is 55–80 mm; said outer tube extends 20–40 mm; the diameter of said outer tube is 8–20 mm beyond the open end of said inner tube; the diameter of said auxiliary air port is 3.0–4.0 mm; and the position of said auxiliary air port is spaced apart from said primary flame cone mouth of said inner tube by 5–30 mm.

6. A gas burner comprising an inner tube, an outer tube disposed so as to surround said inner tube, and an auxiliary air supply means formed at a part of said outer tube; means for supplying a mixture of primary air and a combustible gas from one end of said inner tube so as to produce a primary flame cone at a primary flame cone mouth at the other end of said inner tube; means comprising said auxiliary air suply means for supplying auxiliary air to said outer tube so as to produce a secondary flame cone at a secondary flame cone mouth at one end of said outer tube; the amounts of said primary air, said auxiliary air and said gas being so controlled that the combustion characteristics of said primary flame cone may be attained with a boundary velocity gradient in the range of $7\times10^2-4\times10^3$ $sec^{-1}$ and an equivalent ratio in the range of 1.1–2.0; and an oxygen deficiency sensor is provided which operates in response to the detection of the abnormal burning of said primary flame cone so as to interrupt the supply of said gas.

7. A gas burner as defined in claim 6, wherein said oxygen deficiency sensor is a thermocouple.

8. A gas burner as defined in claim 6, wherein said oxygen deficiency sensor comprises an oxygen ion conductive, high-temperature, solid electrolyte.

9. A gas burner as defined in claim 6, wherein said oxygen deficiency sensor comprises an oxygen partial pressure sensor.

10. A gas burner as defined in claim 6, wherein said oxygen deficiency sensor comprises an ion current sensor.

* * * * *